US008985323B2

(12) United States Patent
Ilfrey

(10) Patent No.: US 8,985,323 B2
(45) **Date of Patent: *Mar. 24, 2015**

(54) ARTICLES AND METHODS FOR REACTIVE COMPOSITIONS

(71) Applicant: Citadel Restoration and Repair, Inc., St. Paul, MN (US)

(72) Inventor: Patrick Ilfrey, Onalaska, WI (US)

(73) Assignee: Citadel Restoration and Repair, Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/815,283

(22) Filed: Feb. 15, 2013

(65) Prior Publication Data

US 2013/0161210 A1 Jun. 27, 2013

Related U.S. Application Data

(60) Continuation of application No. 13/136,533, filed on Aug. 4, 2011, now Pat. No. 8,381,903, which is a division of application No. 12/592,997, filed on Dec. 7, 2009, now abandoned, application No. 13/815,283, which is a continuation-in-part of application No. 13/385,080, filed on Jan. 31, 2012.

(60) Provisional application No. 61/462,365, filed on Feb. 1, 2011.

(51) Int. Cl.
*B65D 81/32* (2006.01)
*B65D 25/08* (2006.01)

(52) U.S. Cl.
CPC ..... *B65D 81/3266* (2013.01); *B65D 25/08* (2013.01)
USPC ..... 206/219

(58) Field of Classification Search
CPC ..... B65D 25/08; B65D 81/3266
USPC ..... 206/219, 221, 222, 484, 568
See application file for complete search history.

(56) References Cited

U.S. PATENT DOCUMENTS

| | | | | |
|---|---|---|---|---|
| 2,683,730 | A | 7/1954 | Seeger et al. | 560/359 |
| 2,950,263 | A | 8/1960 | Abbotson et al. | 521/129 |
| 3,012,008 | A | 11/1961 | Lister | 528/67 |
| 3,064,802 | A | 11/1962 | Jess et al. | 206/219 |

(Continued)

OTHER PUBLICATIONS

Webpage from http://www.burstpouch.com printed Dec. 7, 2009 one-page.

(Continued)

*Primary Examiner* — Bryon Gehman
(74) *Attorney, Agent, or Firm* — Chris Whewell

(57) ABSTRACT

Articles having a plurality of pouches present in a single article, the pouches separately containing chemical materials which are capable of providing a reactive mixture mixed, that cures over time to provide a polymeric coating in certain embodiments. The chemical materials are maintained in separate pouches that are separated by one or more frangible seals. When a frangible seal is broken, such as by application of pressure to the article, the chemical materials in the separate pouches come into contact with one another and may be mixed together. Subsequent to their mixing, the mixture formed is removed from the article, such as by cutting the article with scissors, and applied to any substrate that is desired to be coated, when the chemical materials are selected to be capable of forming a cured coating subsequent to their mixture.

20 Claims, 11 Drawing Sheets

(56) References Cited

U.S. PATENT DOCUMENTS

| | | | | |
|---|---|---|---|---|
| 3,156,352 | A | 11/1964 | Hayhurst | 206/47 |
| 3,294,227 | A | 12/1966 | Schneider et al. | 206/219 |
| 3,344,162 | A | 9/1967 | Rowton | 560/347 |
| 3,362,979 | A | 1/1968 | Bentley | 560/359 |
| 3,394,164 | A | 7/1968 | McClellan et al. | 580/333 |
| 3,983,994 | A | 10/1976 | Wyslotsky | 206/209 |
| 4,010,308 | A | 3/1977 | Wiczer | 428/372 |
| 4,705,814 | A | 11/1987 | Grigsby et al. | 521/159 |
| 4,748,192 | A | 5/1988 | Smith | 521/107 |
| 5,013,813 | A | 5/1991 | Zimmerman et al. | 528/60 |
| 5,124,426 | A | 6/1992 | Primeaux, II et al. | 528/60 |
| 5,126,170 | A | 6/1992 | Zwiener et al. | 427/385.5 |
| 5,209,347 | A | 5/1993 | Fabisiewicz et al. | 208/219 |
| 5,236,741 | A | 8/1993 | Zwiener et al. | 427/385.5 |
| 5,243,012 | A | 9/1993 | Wicks et al. | 528/58 |
| 5,266,671 | A | 11/1993 | Primeaux, II et al. | 528/68 |
| 5,412,056 | A | 5/1995 | Zwiener et al. | 528/73 |
| 5,442,034 | A | 8/1995 | Primeaux, II et al. | 528/60 |
| 5,480,955 | A | 1/1996 | Primeaux, II et al. | 528/60 |
| 5,489,704 | A | 2/1996 | Squiller et al. | 560/35 |
| 5,494,190 | A | 2/1996 | Boettcher | 222/1 |
| 5,504,181 | A | 4/1996 | Primeaux, II et al. | 528/60 |
| 5,516,873 | A | 5/1996 | Hicks et al. | 528/60 |
| 5,559,204 | A | 9/1996 | Squiller et al. | 528/84 |
| 5,561,214 | A | 10/1996 | Yeske et al. | 528/363 |
| 5,580,945 | A | 12/1996 | Wade et al. | 528/49 |
| 5,616,677 | A | 4/1997 | Primeaux, II et al. | 528/66 |
| 5,652,301 | A | 7/1997 | Schmitt et al. | 524/591 |
| 5,731,397 | A | 3/1998 | Primeaux, II et al. | 528/73 |
| 5,733,967 | A | 3/1998 | Wicks et al. | 524/591 |
| 5,736,604 | A | 4/1998 | Luthra | 524/591 |
| 5,821,326 | A | 10/1998 | Kurek et al. | 528/332 |
| 5,847,195 | A | 12/1998 | Roesler | 560/35 |
| 5,954,230 | A | 9/1999 | Blette et al. | 222/1 |
| 6,005,062 | A | 12/1999 | Hansen et al. | 528/68 |
| 6,169,140 | B1 | 1/2001 | Roesler et al. | 524/588 |
| 6,183,870 | B1 | 2/2001 | Hergenrother et al. | 428/423.1 |
| 6,355,829 | B2 | 3/2002 | Roesler et al. | 560/25 |
| 6,399,736 | B1 | 6/2002 | Primeaux, II et al. | 528/60 |
| 6,458,293 | B1 | 10/2002 | Roesler et al. | 252/182.23 |
| 6,491,159 | B2 | 12/2002 | Shibata | 206/219 |
| 6,520,335 | B2 | 2/2003 | Moran et al. | 206/568 |
| 6,590,066 | B1 | 7/2003 | Roesler | 528/328 |
| 6,737,500 | B1 | 5/2004 | Roesler | 528/328 |
| 6,743,451 | B2 * | 6/2004 | Rasile et al. | 206/219 |
| 6,774,206 | B2 | 8/2004 | Danielmeier et al. | 528/328 |
| 6,774,207 | B2 | 8/2004 | Danielmeier et al. | 528/328 |
| 6,790,925 | B2 | 9/2004 | Danielmeier et al. | 528/88 |
| 6,797,798 | B2 | 9/2004 | Johnston | 528/60 |
| 6,833,424 | B2 | 12/2004 | Milhelm | 528/68 |
| 6,935,492 | B1 * | 8/2005 | Loeb | 206/219 |
| 6,968,952 | B2 | 11/2005 | Crevier et al. | 206/219 |
| 7,055,683 | B2 | 6/2006 | Bourque et al. | 206/219 |
| 7,078,475 | B2 | 7/2006 | Klein et al. | 528/64 |
| 7,169,876 | B2 | 1/2007 | Asher | 528/88 |
| 2005/0106395 | A1 | 5/2005 | Asher | 428/423.1 |
| 2005/0234216 | A1 | 10/2005 | Klein et al. | 528/422 |
| 2007/0080078 | A1 | 4/2007 | Hansen et al. | 206/219 |
| 2007/0095681 | A1 | 5/2007 | Jones | 206/219 |

OTHER PUBLICATIONS

Webpage from http://www.burstpouch.com/products.html printed Dec. 7, 2009 two pages.

* cited by examiner

ARTICLES AND METHODS FOR REACTIVE COMPOSITIONS

CROSS-REFERENCE TO RELATED APPLICATIONS

This application is a Continuation of U.S. patent application Ser. No. 13/136,533 filed Aug. 4, 2011 currently pending, which itself was a Divisional application of U.S. patent application Ser. No. 12/592,997 filed Dec. 7, 2009, now abandoned, and to U.S. patent application Ser. No. 13/385,080 filed Jan. 31, 2012 and U.S. Provisional Application No. 61/462,365 filed on Feb. 1, 2011, the entire contents of which are herein incorporated by reference thereto.

TECHNICAL FIELD

This invention relates generally to reactive mixtures. More particularly, it concerns articles having features that enable a person to provide a reactive mixture that is curable into a coating or other manufacture with minimal waste, at any desired stoichiometry, and which afford users of the articles greatly reduced exposure to materials potentially detrimental to the respiratory tract.

BACKGROUND OF THE INVENTION

Various technologies exist whereby components of reactive mixtures that are capable of curing over time to form polymeric coatings and other manufactures are brought together with one another to form such reactive mixtures. Frequently, such components are supplied to end users in separate containers, which may be metal cans. At the time of use, the correct amount of each substance from such separate containers are combined in a third container, mixed until uniform, and then the mixture is used as desired. Some embodiments of the prior art include partially filling a vessel with one component of a reactive mixture and subsequently adding a selected amount of a second component of a reactive mixture. Such prior art method can easily result in incorrect stoichiometry of the reactive components being mixed together, and creates waste materials which are left coating container walls.

SUMMARY OF THE INVENTION

Articles useful for containing plural components of a mixture in distinct compartments for subsequent mixing within the article are provided. An article according to some embodiments of the disclosure comprises a first layer of material and a second layer of material sealingly attached to the first layer of material along a first seal. There is also a frangible seal along which the first layer of material is effectively attached to the second layer of material. The frangible seal is configured and located sufficiently to define a first pouch having a first volume and a second pouch having a second volume within the article. The first pouch contains a first substance and the second pouch contains a second substance that is chemically reactive towards the first substance. When the frangible seal is ruptured such as by applying pressure to the article by hand, the materials present in the pouches become free to mix with one another, to provide a mixture that is curable over time to provide a polymeric or other reaction product material. In some embodiments the strength of the first seal is sufficient to not be ruptured under ambient conditions until a second pressure differential exceeding that required for rupture of the frangible seal by at least one pound per square inch is caused to exist between a volume within the article and the ambient pressure, subsequent to rupture of the frangible seal. In some embodiments the first layer material and second layer material are both polymeric materials, such as plastic films which may optionally contain metallic foil layers as part of their structure. In some embodiments, an article as provided herein includes a re-sealable closure along at least one segment of the perimeter of the article. In some of such embodiments, a segment of the first seal qualifies as being a frangible seal as described herein, and such segment is adjacently disposed to the location of the re-sealable closure, sufficiently to enable the article to be re-sealed (closed off from the ambient surroundings) after rupture of said adjacently-disposed segment of frangible seal.

BRIEF DESCRIPTION OF THE DRAWINGS

Some embodiments are shown and described in the accompanying drawings which form a part hereof, and wherein.

DETAILED DESCRIPTION

Figure 1A:
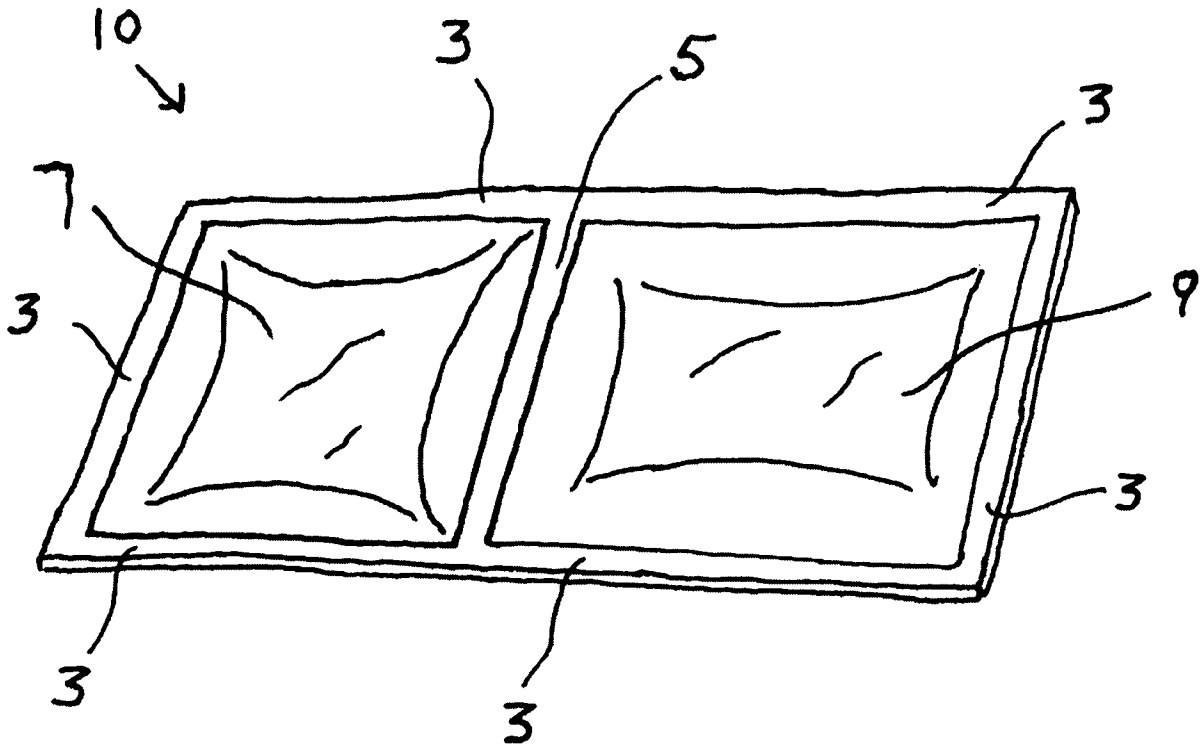
FIG. 1A is a perspective view of an article 10 provided in accordance with an exemplary embodiment of the disclosure.

Referring now to the drawings, wherein the showings are for the purpose of illustrating embodiments of the invention only and not for the purpose of limiting the same, FIG. 1A shows a perspective view of an article 10 provided in accordance with one embodiment of the disclosure. Article 10 is a single manufacture that includes two separate and distinct sealed pouches, including first pouch 7 and second pouch 9. In some embodiments, each of first pouch 7 and second pouch 9 are both formed from the same first layer of material and same second layer of material, which layers are substantially-planar layers of a film material, each of the layers having a perimeter. In some embodiments the first and second layers are sealingly attached to one another substantially along the entirety of their perimeters to provide first seal 3, and also sealingly attached to one another entirely along a segment disposed between first pouch 7 and second pouch 9 to provide a frangible seal 5. Thus, from an overhead perspective, first pouch 7 is bounded by first seal 3 on three of its sides, and by a segment on one of its sides comprising frangible seal 5. Similarly, second pouch 9 is bounded by first seal 3 substantially along its perimeter on three of its sides, and by a segment on one of its sides comprising frangible seal 5, with frangible seal 5 being a common boundary with respect to each of the first and second pouches. By virtue of such structure, these first and second pouches accordingly each comprise an interior volume of space disposed between the first and second layers and within the above-mentioned perimeter and segment boundaries. The volumes of space caused to be present in these pouches by virtue of their construction and dimensions, can be caused to contain solids, liquids, or gaseous substances, in isolation from the ambient surroundings and each other through selection of materials comprising the first and second layers, and seals as described herein. Moreover, additional advantage can be conferred by choice of materials and the strengths of the materials' bonds at areas of attachment of the first and second layers to one another at first seal 3 and segment of frangible seal 5. Although in some embodiments first seal 3 is disposed substantially along the perimeters of first layer 25 and second layer 27, the first seal 3 being substantially disposed along the perimeter of one or both of the layers 25, 27 is not an absolute requirement. In some embodiments, first seal 3 is provided in the form of a continuous closed loop, which seal 3 may exist in circular, rectangular, ovoid, irregular, or any selected geometric shape provided that first seal 3 is continuous and encloses an area on the first and second layers sufficient to define a volume of space between the layers that is isolated from the ambient surroundings by the layers. Some ambient conditions exist at about 25 degrees C. with typical atmospheric pressure and humidity. By such construction, an inner volume is provided between first layer 25, second layer 27 and first seal 3, which inner volume can be thought of as being further divided into two separate pouches 7, 9 by the presence of frangible seal 5.

In some embodiments, frangible seal 5 has a first end portion and a second end portion, with the first end portion of frangible seal 5 being disposed at a location along a first location of first seal 3, and the second end portion of frangible seal 5 being disposed at a location along a second location of first seal 3. In one embodiment, frangible seal 5 can be thought of as dividing such an inner volume into two separate pouches when a single frangible seal 5 is present, and into more pouches when an article as provided herein is made to include additional frangible seals.

Figure 1B:
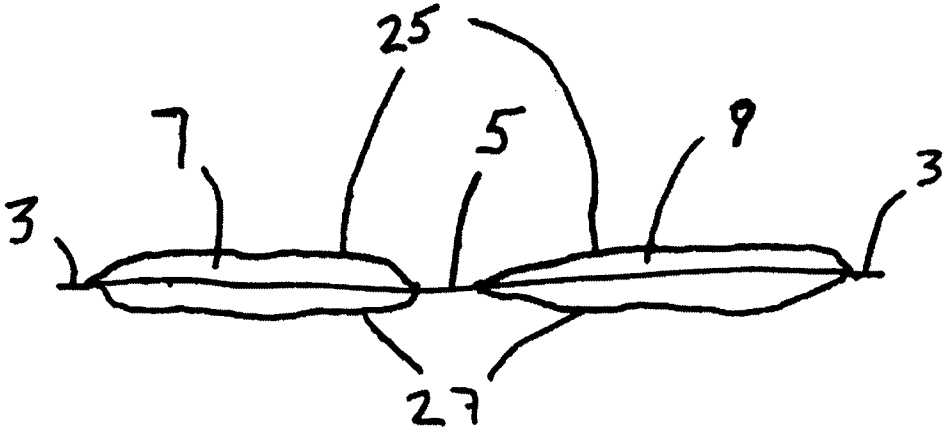
FIG. 1B is a side perspective view of an article 10 provided in accordance with an exemplary embodiment of the disclosure.

FIG. 1B shows a side perspective view of an article 10 provided in accordance with some embodiments of the disclosure, such as that shown in FIG. 1A. In FIG. 1B are shown the respective locations of first seal 3, frangible seal 5, first pouch 7 and second pouch 9. First pouch 7 and second pouch 9 are seen to be bulging in this FIG. 1B, since in this embodiment each of these pouches have been caused to contain substances that are in the liquid state. Moreover, the material from which first pouch 7 and second pouch 9 are each formed are the same top layer 25 and bottom layer 27 for each pouch.

Figure 2A:
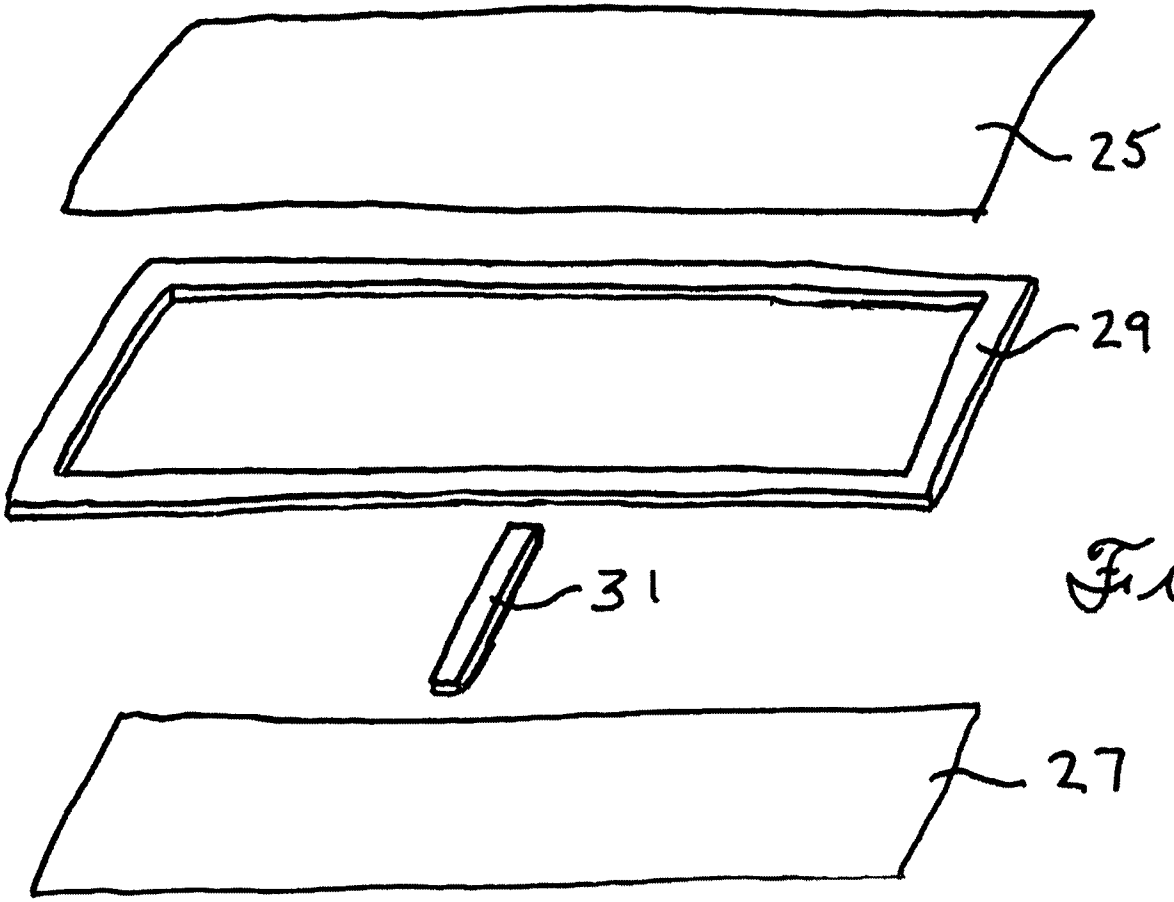
FIG. 2A shows a perspective exploded view of an article according to an exemplary embodiment of the disclosure.

FIG. 2A shows a perspective exploded view of elements of a pouch construction according to some embodiments of the disclosure. In this FIG. 2A are shown top layer 25, bottom layer 27, optional tape layer 29, and optional tape layer segment 31. Prior to completing construction of an article 10 according to some embodiments of the disclosure, these elements are arranged to be in contact with one another, the materials that are desired to be disposed in first pouch 7 and second pouch 9 in the finished article 10 are put into their desired locations, and the perimeters of top layer 25 and bottom layer 27 are effectively sealed to one another along tape layer 29 and segment 31 to provide a construct shown and described in reference to FIG. 1B.

Figure 2B:
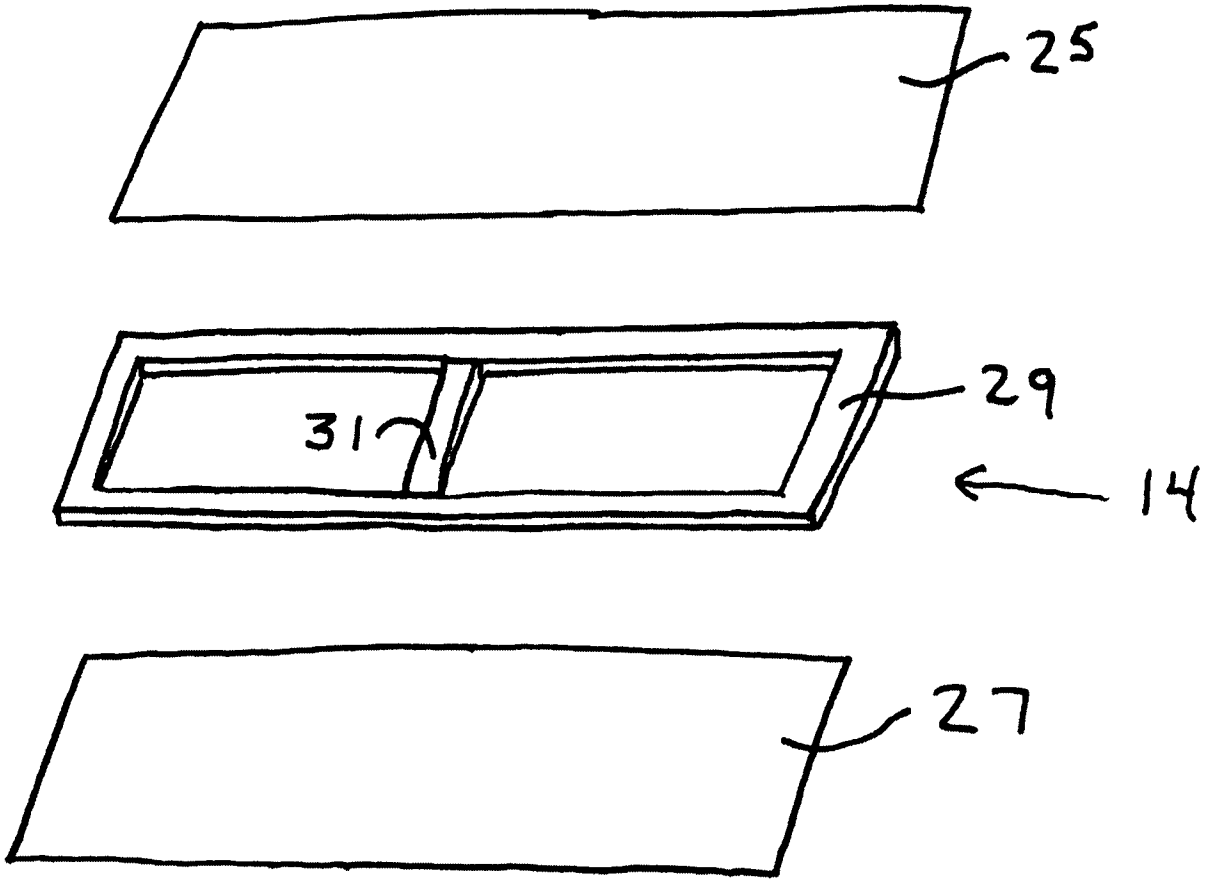
FIG. 2B shows a perspective exploded view of an article according to an exemplary embodiment of the disclosure.

In some embodiments, tape layer segment 31 is placed as shown in FIG. 2B, and a tape layer structure 14 comprising tape layer 29 and tape layer segment 31 in such configuration is thus provided, having a top face and a bottom face. First layer 25 and second layer 27 each have a top face and a bottom face, with the bottom face of first layer 25 being disposed towards the top face of tape layer structure 14, and the top face of second layer 27 being disposed towards the bottom face of tape layer structure 14. In some embodiments, first layer 25, second layer 27 and tape layer structure 14 are maintained in a substantially flat or planar form, and the bottom face of first layer 25 and top face of second layer 27 are caused to be in contact with tape layer structure 14 along their perimeters and the location of tape layer segment 31. Sufficient heat for fusion of the first layer 25 and second layer 27 to the tape layer structure 14 is applied along the perimeters of the first and second layers, and along tape layer segment 31, to provide the structure of article 10 shown and described in reference to FIG. 1A, having a first seal 3 and a frangible seal 5. When such a structure is provided in the ambient atmosphere, first pouch 7 and second pouch 9 will contain the ambient atmosphere. When such a structure is provided in a controlled atmosphere, first pouch 7 and second pouch 9 will contain a gaseous composition comprising the controlled atmosphere, which may be any composition desired that is non-reactive towards the materials from which article 10 is selected to be comprised. In other embodiments, materials in the liquid state may be caused to be disposed in either one or both of first pouch 7 and second pouch 9. Thus, in some embodiments by the structures provided herein, first layer 25 is in effective contact with second layer 27 by virtue of their both being commonly attached to tape layer structure 14. In embodiments when a tape layer structure 14 is selected to not be present, first layer 25 is in effective contact with second layer 27 by virtue of their both being sealingly attached directly to one another by application of heat sufficient for fusion of the layers 25, 27 with one another at or along the locations of first seal 3 and frangible seal 5. In embodiments when tape layer structure 14 is selected to be present, tape layer structure 14 need not necessarily be rectangular in configuration, but may take on any shape selected by one making an article according to the disclosure, provided that the finished article 10, 15 comprises a first seal 3 and frangible seal 5 disposed between two layers of material, and the seals are configured to define separate pouches on the article in which substances may be contained isolated from one another, separated by a frangible seal which upon its rupture provides for the admixture of the substances formerly contained in the separate pouches previously present. Suitable shapes include without limitation polygonal, circular, square, rectangular, ovoid and shaped seals having irregular and non-polygonal geometry.

In some embodiments top layer 25 and bottom layer 27 are each selected to be materials that are heat-fusible to one another, and the optional tape layer structure 14 of FIG. 2B is omitted from article 10 as shown in FIG. 1A. In some embodiments, first layer 25 is comprised of the same material as second layer 27. In other embodiments, second layer 27 is comprised of a different material than first layer 25 is comprised. In some embodiments, tape layer 29 is selected to be comprised of the same material as first layer 25 and second layer 27 are comprised. In other embodiments, tape layer 29 is selected to be comprised of a different material than at least one, and alternately both of which first layer 25 and second layer 27 are comprised. In some embodiments, tape layer segment 31 is selected to be comprised of the same material that tape layer 29 is comprised. In other embodiments, tape layer segment 31 is selected to be comprised of a material that is different than that of which tape layer 29 is comprised. Thus, first layer 25, second layer 27, tape layer 29, and tape layer segment 31 may in some embodiments all be comprised of the same material. In other embodiments, each of these named elements comprising the first layer 25, second layer 27, tape layer 29 and tape layer segment 31 may be independently selected to be comprised of the same or different materials than any one or more, or all of the remaining named elements, in any combination of likeness or difference of composition of these elements desired.

Materials suitable for construction of an article as provided herein from which first layer 25 and second layer 27 may each be comprised, including embodiments wherein these layers are compositionally different of one another, and embodiments wherein both are comprised of the same material, include without limitation: polyolefin homopolymers, polyolefin copolymers, styrene polymers, styrene copolymers, NYLON® polymers, MYLAR® polymers, metallic foils, and blends, multi-layered, and composite structures containing any number of the foregoing in any proportion, or any arrangement of layers when 25, 27 are selected to be comprised of multi-layered materials. When metallic foils are employed as a component layer of a multi-layered structure herein, in some embodiments the metallic foil is present as an inner layer of a multi-layered structure. One non-limiting example of a material suitable for use as the first layer 25 and second layer 27 in an article herein is known as ESP-500 foil laminate film, available from Eastern States Packaging, Inc. of Stoughton, Mass., USA 02072. In some embodiments the first layer 25 and second layer 27 are comprised of materials having a thickness in the range of between about 0.05 millimeters to about 0.50 millimeters, including all thicknesses and ranges of thicknesses therebetween, as determined by TAPPI T411. In some embodiments the puncture resistance of the first layer 25 and second layer 27 is at least about 14 lbs, per FED101, 2065, and the tensile modulus is at least about 25 pounds per inch, TAPPI T494. The Mullen Burst is between about 40 and about 85 PSI, including all values and ranges of values therebetween per TAPPI T403. Atmospheric water vapor and oxygen transmission rates of materials suitable for use as first layer 25 and second layer 27 are low enough so that pouch contents to not react or degrade over customary storage time and conditions. In some embodiments, first layer 25 and second layer 27 are both comprised of a polymeric film material, which may be selected from the aforesaid polymeric materials.

Suitable materials from which tape layer 29 and tape layer segment 31 may each be comprised, independently of one another or both being comprised of the same material, include without limitation films comprising waxes, adhesive-coated polymeric films, adhesive coated tapes, amorphous polyalpha olefin polymers, blends comprising ethylene/methacrylic acid ionomer and propylene/ethylene copolymers, any mixtures comprising any of the foregoing, and other materials and blends known in the art as being compatible with first layer 25 and second layer 27 from the standpoint of forming a seal therewith that is frangible upon applied pressure to first pouch 7 or second pouch 9, under force exerted by typical human hands upon an article provided herein. In some embodiments, tape layer 29 and segment 31 comprise a polymer film which has a known adhesive substance disposed on either one of its two faces, or on both of its faces, the adhesive substance selected being compatible with the other materials present on the article provided herein.

The present disclosure provides for the presence of liquid substances in first pouch 7 and second pouch 9 of an article 10 shown in FIG. 1A. In some embodiments, the liquid substances caused to be present in first pouch 7 and second pouch 9 are liquid substances that are different from one another in composition. In other embodiments, the liquid substances caused to be present in first pouch 7 and second pouch 9 are liquid substances that are different from one another in composition and are reactive towards one another, capable of forming new compositions or reaction products when mixed.

In some embodiments of an article 10 according to the disclosure, first pouch 7 is caused to contain a liquid composition that includes an organic isocyanate, which may include organic polyisocyanates, and second pouch 9 is caused to contain a liquid composition that includes material that is reactive towards an organic isocyanate, such as a polyamine. A tape layer structure 14 is selected to be present, and the material from which tape layer 29 is comprised is selected to be different from that of tape layer segment 31, to provide a first seal 3 having greater strength when a pouch present on an article provided herein is placed under pressure greater than ambient, than the frangible seal 5 on finished article 10. The greater strength of first seal 3 with respect to that of frangible seal 5 in one embodiment manifests itself when a sufficient amount of pressure is applied to either first pouch 7 or second pouch 9, to cause frangible seal 5 to rupture or fail, while first seal 3 remains intact under that same amount of applied pressure. That is to say, it is possible when proceeding according to some embodiments of this disclosure for a person to grasp article 10 as described, and squeeze it sufficiently with the hands to cause rupture of frangible seal 5 between first layer 25 and second layer 27, while first seal 3 remains intact. Upon such occurrence, the liquid substances present in first pouch 7 and second pouch 9 become free to admix with one another, the former first pouch 7 and second pouch 9 now collectively comprising a new single pouch that is larger in volume than former first pouch 7 and second pouch 9, which new single pouch is bounded on all of its sides by first seal 3 and of course layers 25, 27. By manually applying alternate gentle pressure to the areas of article 10 following rupture of frangible seal 5, the liquid substances formerly present in first pouch 7 and second pouch 9 can be blended and caused to form a single homogeneous mixture contained in the new single pouch.

This is of particular advantage when first pouch 7 and second pouch 9 each initially separately contain an organic polyisocyanate and a polyamine, respectively, for then a reactive polyurea precursor mixture can be readily provided as a homogeneous mixture using article 10. Following provision of a homogeneous mixture from blending of the contents of first pouch 7 and second pouch 9 after rupture of frangible seal 5, the new single pouch may be cut open, and its contents dispensed onto a substrate such as by pouring, for distribution about the substrate. In some embodiments, the substrate is a floor surface, and further distribution is carried out using a squeegee or other implements known in the art for spreading liquid substances into layers of desired thicknesses, in order to provide a polyurea precursor coating layer on the floor surface, which cures with time to form a polyurea floor coating. Articles as provided herein are not limited to providing coating materials for floors. Other substrates to which the use of an article as provided by the present disclosure is helpful in providing reactive mixtures include without limitation walls, railcars, roads, motorized vehicles, cargo containers, processing equipment, sea-going vessels, and all substrates desirably coated by a polyurea or other coating.

As alternates to an article 10 having polyurea precursor materials present in first pouch 7 and second pouch 9, the present disclosure provides articles 10 having precursor materials present in first pouch 7 and second pouch 9 that are capable of forming reactive mixtures that yield polymeric materials other than polyurea coatings. Such other polymeric materials include water-based epoxy coatings precursors, solvent-based epoxy polymer coatings precursors, polyaspartate polymer coatings precursors, polyurethane polymer coatings precursors, and acrylic emulsion polymer coatings precursors.

When it is desired to provide a reactive mixture capable of forming a polyurethane or a polyurea, an organic isocyanate is selected to be present in either the first pouch 7 or first pouch 9 in an article 10 according to the disclosure. When it is desired to provide a reactive mixture capable of forming an epoxy, an organic epoxy material is selected to be present in either the first pouch 7 or first pouch 9 in an article 10 according to the disclosure. The remaining pouch, which does not contain either an organic isocyanate or an organic epoxy material, is caused to contain an organic polyamine when it is desired to provide a reactive mixture capable of curing and forming an epoxy or a polyurea material. For cases in which it is desired to provide a reactive mixture capable of forming a polyurethane, an organic polyol is provided in the remaining pouch that does not contain the organic isocyanate.

Thus, in some embodiments, two separate and distinct pouches present on an article as provided herein are caused to contain complementary reactive substances, which when mixed provide a mixture having a cure time after which a polymeric product results, which product may include without limitation, a floor coating. One example of complementary reactive substances is an organic isocyanate and an organic polyamine, which form a polyurea polymer after mixing and curing. Another example of complementary reactive substances is an organic isocyanate and an organic polyol, which form a polyurethane polymer after mixing and curing. Another example of complementary reactive substances is an organic epoxy and an organic polyamine, which form an epoxy polymer after mixing and curing. Another example of complementary reactive substances is an organic isocyanate and a polyaspartic ester, which form a polyaspartate polymer after mixing and curing.

Compositions from which polyurethane and polyurea materials may be produced typically contain at least one organic polyisocyanate compound. Isocyanates which may be present as an "A" component in a pouch 7 or 9 of an article 10 in accordance with this disclosure include any number of suitable aromatic or aliphatic-based polyisocyanates, such as toluene di-isocyanate, di-phenylmethane di-isocyanates, and isocyanate-containing prepolymers or quasi-prepolymers. These are standard isocyanate materials known to those skilled in the art. Preferred exemplary materials include MDI-based quasi-prepolymers such as those available commercially as RUBINATE® 9480, RUBINATE® 9484, and RUBINATE® 9495 from Huntsman International, LLC. Suitable aromatic polyisocyanates also include p-phenylene di-isocyanate, polymethylene polyphenylisocyanate, 2,6-toluene di-isocyanate, dianisidine di-isocyanate, bitolylene di-isocyanate, naphthalene-1,4-di-isocyanate, bis(4-isocyanatophenyl) methane, bis(3-methyl-3-isocyanatophenyl)methane, bis(3-methyl-4-isocyanatophenyl) methane, and 4,4'-diphenylpropane di-isocyanate. Other aromatic polyisocyanates useful in accordance with this disclosure are methylene-bridged polyphenyl polyisocyanate mixtures which have a functionality of from about 2 to about 4. These latter isocyanate compounds are generally produced by the phosgenation of corresponding methylene bridged polyphenyl polyamines, which are conventionally produced by the reaction of formaldehyde and primary aromatic amines, such as aniline, in the presence of hydrochloric acid and/or other acidic catalysts. Known processes for preparing polyamines and corresponding methylene-bridged polyphenyl polyisocyanates therefrom are described in the literature and in many patents, for example, U.S. Pat. Nos. 2,683,730; 2,950,263; 3,012,008; 3,344,162 and 3,362,979. Usually methylene-bridged polyphenyl polyisocyanate mixtures contain about 20 to about 100 weight percent methylene di-phenyl-di-isocyanate isomers, with the remainder being polymethylene polyphenyl di-isocyanates having higher functionalities and higher molecular weights. Typical of these are polyphenyl polyisocyanate mixtures containing about 20 to about 100 weight percent diphenyl-di-isocyanate isomers, of which about 20 to about 95 weight percent thereof is the 4,4'-isomer with the remainder being polymethylene polyphenyl polyisocyanates of higher molecular weight and functionality that have an average functionality of from about 2.1 to about 3.5. These isocyanate mixtures are known, commercially available materials and can be prepared by the process described in U.S. Pat. No. 3,362,979. One useful aromatic polyisocyanate is methylene bis(4-phenylisocyanate) or MDI. Pure MDI, quasi-prepolymers of MDI, modified pure MDI, etc. are useful as an ingredient present in a pouch 7 or 9 herein. Since pure MDI is a solid and, thus, often inconvenient to use, liquid products based on MDI or methylene bis(4-phenylisocyanate) are also useful herein. U.S. Pat. No. 3,394,164 describes a liquid MDI product. More generally, uretonimine modified pure MDI is included also. This product is made by heating pure distilled MDI in the presence of a catalyst. The liquid product is a mixture of pure MDI and modified MDI. The term isocyanate also includes quasi-prepolymers of isocyanates or polyisocyanates with active hydrogen containing materials. A hydrogen is an active hydrogen if it is capable of participating in the Zerevitinov reaction (Th. Zerevitinov, Berichte 40, 2023 (1907) to liberate methane from methylmagnesium bromide.

Any of the isocyanates mentioned above may be used as an, or in an, isocyanate component in the present invention, either alone or in combination with any other aforementioned isocyanates and conventional polymer additives, catalysts, and stabilizers. Other polyisocyanates and mixtures including polyisocyanates may be employed as those of ordinary skill will realize after considering this disclosure.

The isocyanates can also be selected from aliphatic isocyanates of the type described in U.S. Pat. No. 4,748,192. These include aliphatic di-isocyanates and, more particularly, are the trimerized or the biuretic form of an aliphatic di-isocyanate, such as hexamethylene di-isocyanate ("HDI"), or the bi-functional monomer of the tetraalkyl xylene di-isocyanate, such as the tetramethyl xylene di-isocyanate. Cyclohexane di-isocyanate is also to be considered a useful aliphatic isocyanate. Other useful aliphatic polyisocyanates are described in U.S. Pat. No. 4,705,814. They include aliphatic di-isocyanates, for example, alkylene di-isocyanates with 4 to 12 carbon atoms in the alkylene radical, such as 1,12-dodecane di-isocyanate and 1,4-tetramethylene di-isocyanate. Also useful are cycloaliphatic di-isocyanates, such as 1,3 and 1,4-cyclohexane di-isocyanate as well as any mixture of these isomers, 1-isocyanato-3,3,5-trimethyl-5-isocyanatomethylcyclohexane (isophorone di-isocyanate); 4,4'-, 2,2'- and 2,4'-dicyclohexylmethane di-isocyanate as well as the corresponding isomer mixtures, and the like. All patent documents mentioned in this disclosure are herein incorporated by reference thereto. Generally speaking, the organic isocyanate used is an organic polyisocyanate, having more than one isocyanate reactive group present in the molecule; the term "isocyanate" as used in this disclosure and its appended claims includes polyisocyanates.

When it is desired to provide a reactive mixture using an article provided hereby that yields a curable epoxy mixture, one of the materials present in pouch 7 or 9 is selected to be any material or mixture of two or more materials which contains at least two epoxy groups in its(their) molecular structure. Materials useful in providing curable epoxy mixtures are well-known in the art and the present disclosure provides for the use of all known organic epoxy resins, including without limitation epoxy NOVOLAC D.E.N.® 438 resin, ARALDITE® EPN 1180 resin, and NOVOLAC D.E.N.® 431 resin, and other epoxy resins specified in US Patent Application US 2005/0234216. Moreover, polyamines mentioned therein are also useful in providing an article 10 according to the disclosure.

For instances in which an article provided hereby is desirably employed to provide a reactive mixture from which either a curable epoxy or polyurea composition results, a polyamine will be present in one of pouches 7 or 9 that does not contain an organic epoxy or isocyanate component. Polyamines useful for providing polyureas and cured epoxies are well-known in the art, and the present disclosure includes the use of any and all organic polyamines known to be useful in providing cured epoxies and polyureas. These include primary and secondary polyamines, whether they are aliphatic, aromatic or polyether polyamines, including without limitation those suitable polyamines sold under the JEFFAMINE® trademark and other trademarks by the Huntsman family of companies including Huntsman International, LLC.

For instances in which an article provided hereby is desirably employed to provide a reactive mixture from which either a curable polyurethane composition results, a polyol will be present in one of pouches 7 or 9 that does not contain an organic isocyanate component. Polyols useful for providing polyurethanes are well-known in the art, and the present disclosure includes the use of any and all organic polyols, mixtures thereof, and mixtures including same, known by those skilled in the art to be useful in providing cured polyurethanes.

Thus, according to some embodiments, an article 10 according to the disclosure comprises a first pouch 7 and a second pouch 9 having a frangible seal disposed between them, which may be a frangible seal 5. It is common for one portion of a two-part curable composition to be called the "A" portion, and the remaining portion to be termed the "B" portion. Often, in the case of polyurea and polyurethane compositions, the isocyanate component is considered as being the "A" side, with the remaining component, either the polyamine or polyol, respectively, as the case may be, being termed the "B" side. According to the present disclosure, either the A or B side may be caused to be disposed in first pouch 7, with the remaining reactive component not present in the first pouch being caused to be present in the second pouch 9.

The stoichiometry of mixture is well-known in the art also, that is, the relative amounts of A-side component(s) and B-side component(s) that are necessary to be present in order to provide complete reaction between the components when they are mixed together, without either one being present in any appreciable excess from a reactivity standpoint, unless desired. These amounts are readily determinable by those skilled in the art. However, while the present invention has advantage that pouches 7, 9 of an article 10 according to the disclosure may be charged with exact amounts of A and B components in separate pouches for precise and perfect stoichiometry, which reduces waste and provides a perfect and uniform product with every employment of an article 10 as provided hereby, the present disclosure also includes instances in which either of first pouch 7 or second pouch 9 contains a reactant that is present in excess of the stoichiometric amount necessary to react with the component in the other or another pouch present. For example, when an isocyanate is selected to be present and is present in excess relative to the amount of polyol present in another pouch present, rupture of frangible seal 5 and mixture of the components can result in formation of a pre-polymer composition, which can be further reacted with other isocyanate-reactive materials at a later time, or can be reacted slowly by exposure to ambient air due to its inherent moisture content, to provide moisture-curable compositions, as such moisture-curable compositions are known to those skilled in the art.

Figure 3:
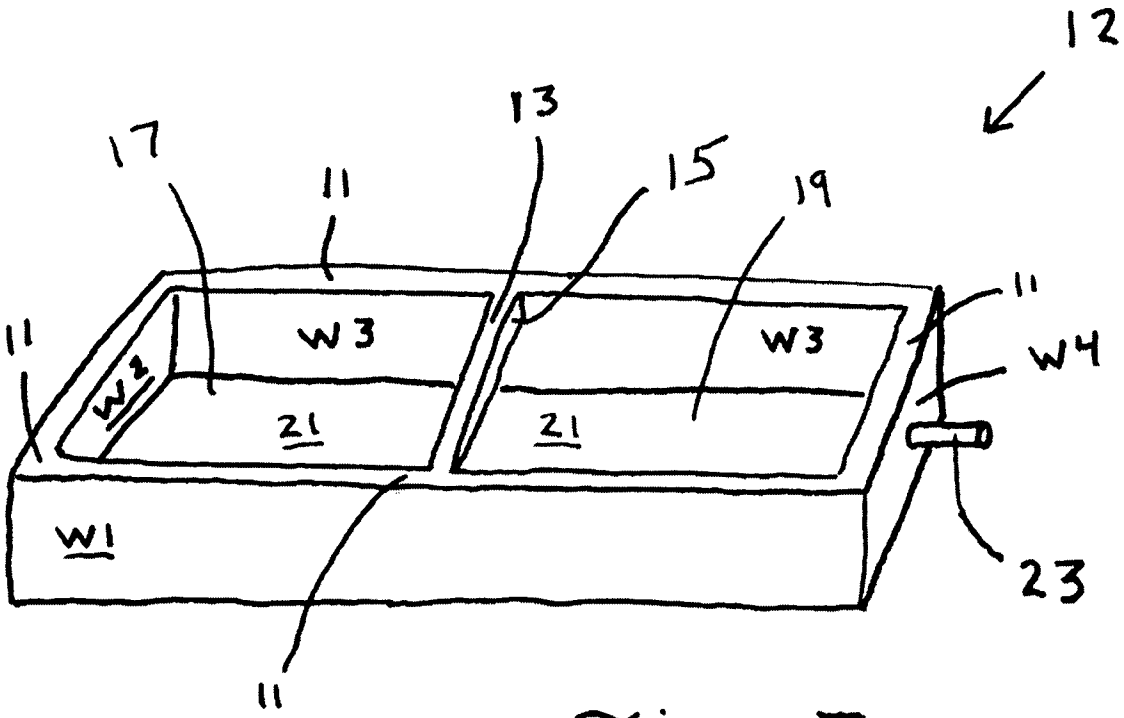
FIG. 3 shows a perspective view of a fixture useful in providing an article according to an exemplary embodiment of the disclosure.

One method for providing an article 10 as shown and described herein utilizes a fixture 12 shown in the perspective view of FIG. 3. Fixture 12 comprises four walls W1, W2, W3, and W4 arranged as shown to provide a substantially-rectangular geometric solid configuration having an open interior. In this configuration, each of walls W1, W2, W3, and W4 has a top edge, which when taken together collectively define top edge 11. There is also segment 15 having a first end portion, a second end portion, and a top edge 13, wherein the first end portion of segment 15 is attached to W3 and wherein the second end portion of segment 15 is attached to W1, sufficiently so that the flat top surface 13 of segment 15 is flush or is substantially co-planar with the flat top edge 11; the flat top edge 11 and flat top surface 13 collectively residing substantially in the same plane. In one embodiment, components of fixture 12 are comprised of aluminum and attachment of the various elements it comprises to one another as shown is made by conventional fastening means, such as by welding. In one embodiment, the aluminum of which fixture 12 is comprised is hollow, and electrical heating elements are present inside the elements of fixture 12 beneath flat top edge 11 and flat top surface 13 so that when the heating element(s) are energized, flat top edge 11 and top surface 13 can be caused to achieve a temperature sufficient for fusing first layer 25 and second layer 27 together, in either the presence or absence of a tape layer structure 14. There is a floor 21 disposed along the bottoms of walls W1, W2, W3, and W4, and also a vacuum nipple 23 that is attached to a hole disposed all of the way through wall W4 to the interior of the fixture 12. This enables application of a source of reduced pressure, such as a vacuum pump, to vacuum nipple 23, which can cause a reduced pressure to exist in both first chamber 17 and second chamber 19, since segment 15 does not extend all of the way down to floor 21. A second fixture 12 is also provided.

Figure 4:
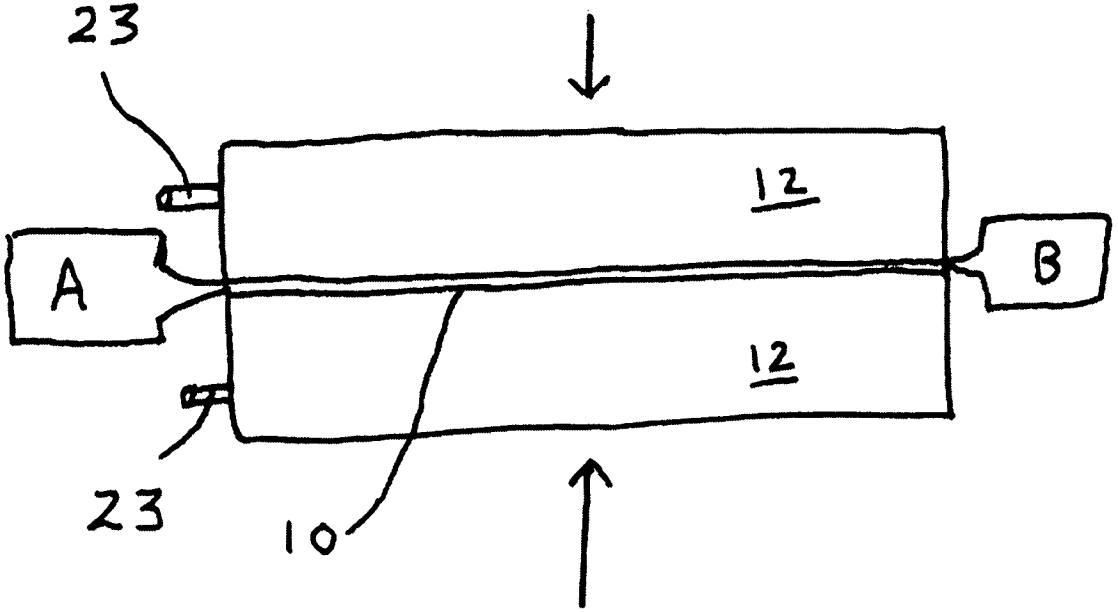
FIG. 4 shows a perspective view of a fixture useful in providing an article according to an exemplary embodiment of the disclosure.

Thus, when using a pair of fixtures 12 to provide an article 10 according to one embodiment of the disclosure, material comprising first layer 25 is placed over fixture 12 such that first layer 25 is in contact with flat top edge 11 and top surface 13. A tape layer structure 14 is next placed over the first layer 25 so that the contour of tape layer structure 14 is disposed over flat top edge 11 and top surface 13, and then second layer 27 is placed over the tape layer structure 14. A second fixture 12 is subsequently placed over second layer 27 so that its flat top edge 11 and top surface 13 are coincident with top edge 11 and top surface 13 of the first fixture 12, with first layer 25, tape layer structure 14, and second layer 27 being disposed between the two fixtures 12, as shown in FIG. 4. Reduced pressure may be applied to vacuum nipples 23, and the desired liquid components may be caused to enter what are now first pouch 7 and second pouch 9, by their injection from reservoirs A and B in FIG. 4 through removable conduits having thin profiles. Heating elements present in the structures of fixtures 12 are energized, which causes fusion of the first and second layer materials 25, 27 to the tape layer structure 14, and the conduits through which materials from reservoirs A and B can be metered into first pouch 7 and second pouch 9 are opened, dispensing desired amounts of components A and B into first pouch 7 and second pouch 9. Once components A and B have been admitted into first pouch 7 and second pouch 9, the conduits are withdrawn, heat to the perimeter 3 and pressure between fixtures 12 is increased, and heating is subsequently ceased which causes fusion of the seals and the liquid materials to remain encapsulated in first pouch 7 and second pouch 9. The fixtures 12 are then separated from one another to provide article 10. In an alternate embodiment a non-stick fabric layer is present on top of flat top edge 11 and top surface 13 to prevent polymer of layers 25, 27 from sticking to the aluminum of fixture 12. In an alternate embodiment, the heating elements are wires embedded in fabric disposed on top edge 11 and top surface 13, which fabric has no affinity for the material from which first layer 25 and second layer 27 are comprised. In one embodiment, the fixtures 12 are held in contact with one another by means of a hydraulic press. In additional alternate embodiments, the present disclosure includes the use of methods and apparati known to those skilled in the art to provide an article 10 as herein shown and described.

Figure 5:
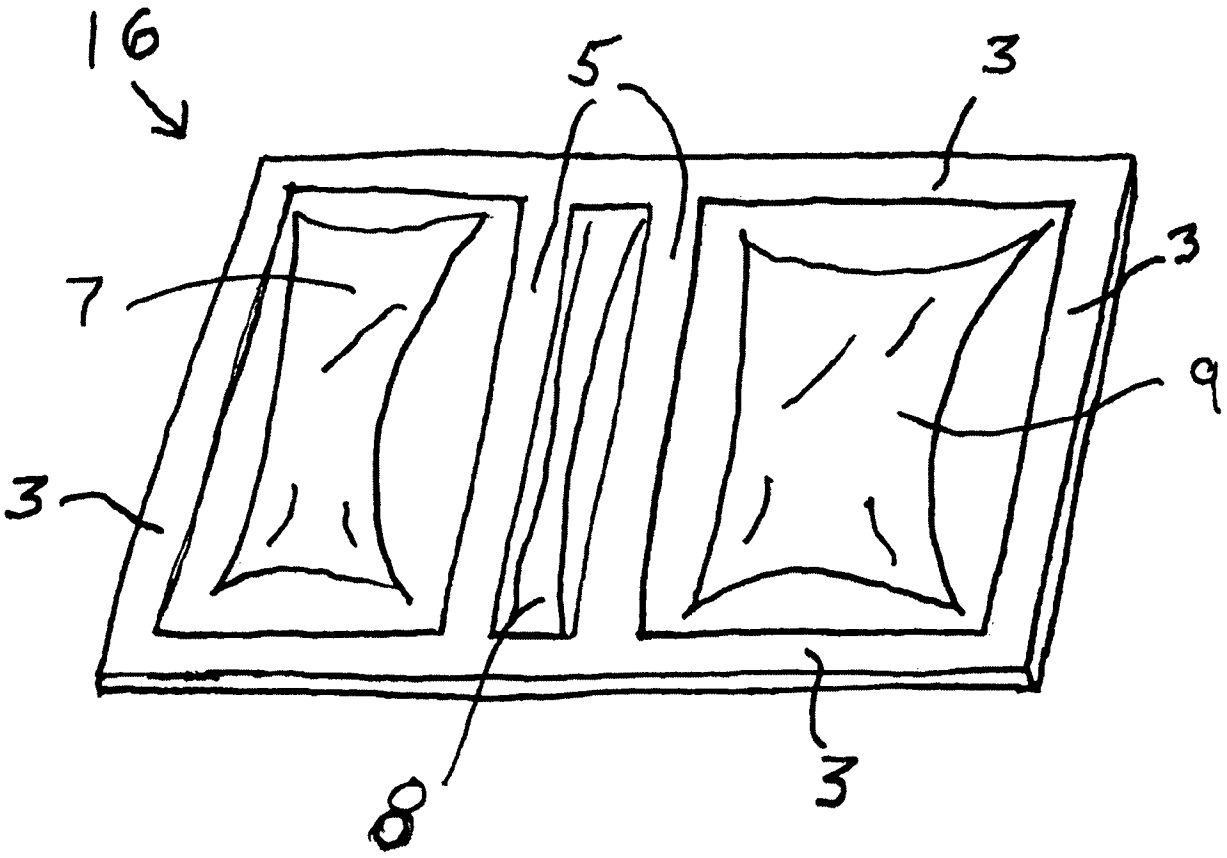
FIG. 5 is a perspective view of an article 16 provided in accordance with an alternate embodiment of the disclosure.

Moreover, this disclosure provides an article 16 as an alternate embodiment shown in the perspective view of FIG. 5 wherein a third pouch 8 is present, in addition to first pouch 7 and second pouch 9. In this embodiment, third pouch 8 is caused to contain a substance that is desired to be included in a composition comprising an admixture of the contents of first pouch 7 and second pouch 9, but is not desirably included as a component of the contents of first pouch 7 or second pouch 9, due to its potential reactivity or instability in the presence of such contents or for any other reason. In some embodiments, first pouch 7 and second pouch 9 contain an organic isocyanate and an isocyanate-reactive substance respectively, and third pouch 8 is made to contain, without limitation, a material selected from the group consisting of: diluents, catalysts that catalyze the reaction between the contents of pouches 7 and 9, fillers, colorants, plasticizers, stabilizers, preservatives, pre-polymers, uv light inhibitors, and crosslinking agents. In other embodiments, third pouch 8 is made to contain, without limitation, a material selected from the group consisting of: dry fillers, quartz, sand, colored sand, sanded grout mix, unsanded grout mix, and flint particles. However, third pouch 8 may contain any substance generally recognized in the art as being beneficial when present in a mixture from which a curable material results over the course of time after the mixture is made. In additional embodiments, third pouch 8 may contain a substance that is reactive to the contents of pouch 7, that is different in composition than a material present in pouch 9 that is also reactive towards the contents of pouch 7. For example, pouch 7 may be caused to contain an isocyanate, pouch 8 may contain a polyol, and pouch 9 may contain a polyamine. When mixed, the composition is capable of forming a mixed polyurethane and polyurea coating precursor reactive mixture. Thus, by this structure, it is possible to rupture the frangible seal 5 disposed between the first pouch 7 and third pouch 8, and mix the contents of these pouches, and if desired, permit them to react for a chosen amount of time prior to rupturing the frangible seal 5 that is disposed between the second pouch 9 and third pouch 8 and subsequently creating a mixture comprising the contents of all pouches 7, 8, 9 effectively in a single pouch bounded only by first seal 3. By extension, the present disclosure provides multiple-pouched articles having any number of separate pouches present in a single article as are desired, each separated from one another by a frangible seal. This is beneficial from a manufacturing standpoint, since articles as provided herein can be mass-produced on a web having multiple pouches, and subsequently selectively cut into single manufactures having two, three, or any desired number of pouches at a later time.

The first seal 3 and frangible seal 5 may each be present having various widths in different embodiments of an article provided according to this disclosure. When no tape layer structure 14 is selected to be present, in some embodiments frangible seal 5 is made to be narrower than first seal 3. In an article provided according to some embodiments, first seal 3 may have any width in the range of between about three millimeters and about twenty-five millimeters, including all widths and ranges of widths therebetween, with a width of about six millimeters being preferable in some embodiments. In an article provided according to some embodiments, frangible seal 5 may have any width in the range of between about one millimeter and about twenty-five millimeters, including all widths and ranges of widths therebetween, with a width of about six millimeters being preferable in some embodiments. The selected widths of first seal 3 and frangible seal 5 may be chosen independently of one another from these ranges for all embodiments of the disclosure, provided that frangible seal 5 is weaker than first seal 3 under pressure applied to a pouch present sufficient to rupture frangible seal 5, leaving first seal 3 intact.

In some embodiments, the strength of the first seal 3 is made to be sufficient to not be ruptured or compromised until a pressure exceeding ambient in any selected amount of pressure between about 7.5 pounds per square inch to about 10 pounds per square inch, including all pressures and ranges of pressures therebetween, or greater, is caused to exist within a pouch bounded by first seal 3 of an article provided herein. In some embodiments of an article 10 according to the disclosure, the strength of first seal 3 is made to be sufficient to not be compromised under ambient conditions until a pressure differential in any amount between about 7.5 pounds per square inch and about 10 pounds per square inch, including all pressures and ranges of pressures therebetween, or greater, is caused to exist between the interior volume of at least one of either of said first pouch 7 or said second pouch 9 and the pressure of the ambient surroundings. As used in the foregoing sentence, a compromised seal is one which allows material present in either of said first pouch 7 or said second pouch 9, or their combined volumes comprising a new single interior volume in said article subsequent to rupture or compromise frangible seal 5, to flow to the external surroundings of an article provided herein. In some embodiments, the strength of the frangible seal 5 is sufficient to not be ruptured or compromised until a pressure exceeding ambient in any amount of pressure between about two pounds per square inch and about six pounds per square inch, including all pressures and ranges of pressures therebetween, is caused to exist within any pouch 7, 9, etc. present on or in an article provided herein. In some embodiments of an article according to the invention, the strength of frangible seal 5 is caused to be sufficient to not be compromised under ambient conditions until a pressure differential of any amount between about two pounds per square inch to about six pounds per square inch, including all pressures and ranges of pressures therebetween, is caused to exist between the interior volumes present in at least two pouches 7, 9, etc. present on or in the article. As used in the foregoing sentence, a compromised seal is one which allows material present in either or both of said first pouch 7 and said second pouch 9, or between pouch 8 (when present) and either of pouches 7, 9, to mix with one another between the layers 25, 27 of an article provided herein. Thus, in an article according to some embodiments of the disclosure first seal 3 does not rupture prior to rupture of frangible seal 5 when a steadily-increasing pressure is applied to one of the pouches present on the article. In some embodiments, by exercising care in slowly applying pressure to a pouch present on article as provided herein of say about five to six pounds per square inch above ambient, frangible seal 5 is caused to rupture, enabling the contents of the volumes of pouches 7, 9 to mix with one another, with first seal 3 remaining intact. In some embodiments of use of an article provided herein, an external pressure above ambient of any amount between about two pounds per square inch to about six pounds per square inch, including all pressures and ranges of pressures therebetween, is applied to either of pouches 7, 9, causing rupture or compromise of frangible seal 5, enabling subsequent mixing of the contents of pouches 7, 9 with one another, with first seal 3 remaining intact. The strengths of either the first seal 3 and frangible seal 5 as specified above may be caused to be present in an article according to this disclosure independently of the strength of the remaining seal.

In one non-limiting example, an article 10 is provided here as shown and described in relation to FIG. 1A, and first pouch 7 contains RS DIY 523 Polyaspartic Top Coat Part A product, available from RockSolid Floors Company of 3001 103$^{rd}$ Lane NE of Blaine, Minn. USA, and second pouch 9 contains a stoichiometric amount of RS DIY 523 Polyaspartic Top Coat Part B product, available from RockSolid Floors Company, sufficient to react with the material present in first pouch 7. Frangible seal 5 is fabricated to be ruptured at an applied pressure to the article 10 that is less than the applied pressure required to rupture first seal 3. In this example, frangible seal 5 is of sufficient strength to rupture at an applied pressure of about six pounds per square inch, applied to either first pouch 7 or second pouch 9. In some embodiments, first seal 3 is of sufficient strength so as to not be ruptured under an applied pressure of less than 10 pounds per square inch.

In another non-limiting example, an article 10 is provided here as shown and described in relation to FIG. 1A, and first pouch 7 contains Polyurea BASE Coat Part A product, available from RockSolid Floors Company. Second pouch 9 contains a stoichiometric amount of Polyurea BASE Coat Part B product, available from RockSolid Floors Company, sufficient to react with the material present in first pouch 7. Frangible seal 5 is fabricated to have sufficient strength to be ruptured at an applied pressure to the article 10 that is less than the applied pressure required to rupture first seal 3. In this example, frangible seal 5 ruptures at an applied pressure of about six pounds per square inch, applied to either first pouch 7 or second pouch 9. First seal 3 is of sufficient strength so as to not be ruptured when a pressure less than about 10 pounds per square inch is applied to either of said first pouch 7 or second pouch 9.

An article as provided herein also provides for workers using the article to be exposed to lower levels of airborne organic compounds over prior art means for preparing reactive mixtures as herein described. Within this context, workers includes ordinary persons such as homeowners who are not professional floor coatings installers, but nevertheless desire to provide their own floor coating. Proceeding to prior art methods often requires a worker to weigh or otherwise measure an amount of say, an organic isocyanate. When proceeding using an article according provided hereby, the amounts of the components of the reactive mixture to be generated are pre-measured, all that is necessary is for the worker to rupture the frangible seal 5 by applying pressure to the article, mixing the contents manually by squishing the pouch back and forth by hand, and then cutting the first seal 3 to enable the resultant mixture to be dispensed onto a substrate. An article as provided herein thus greatly reduces or substantially eliminates potential exposure of do-it-yourself and other types of persons to volatile organic compounds, including those such as organic isocyanates and volatile amines.

Figure 6:
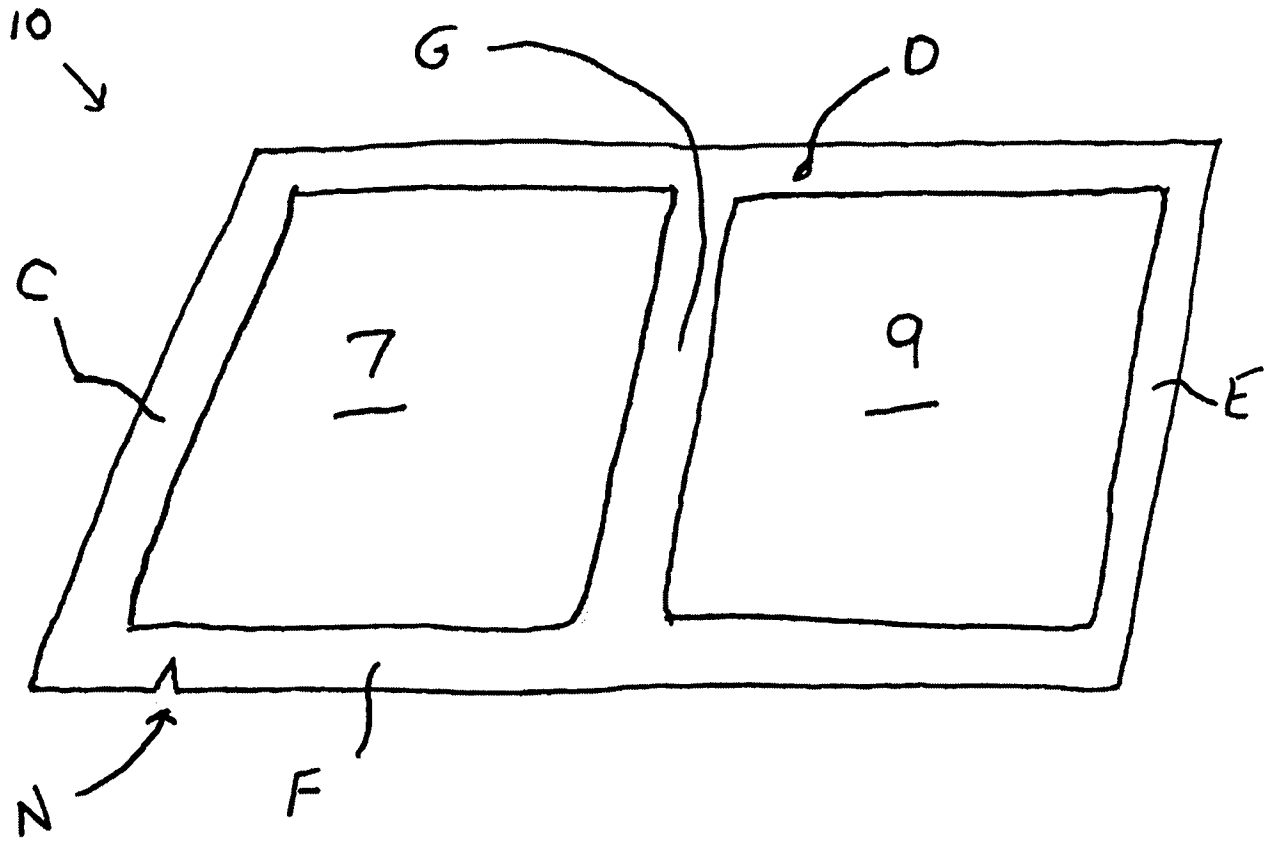
FIG. 6 is a perspective view of an article 10 provided in accordance with further alternate embodiments of an article according to the disclosure.

In alternate embodiments of an article provided hereby, any portion of, or the entirety of, any one or more of first seal 3 and frangible seal 5 present on an article as provided herein may be replaced by a re-closable seal, including those known in the art and those exemplified by U.S. Pat. Nos. 5,070,584; 5,140,727; and 5,647,100 (all incorporated herein by reference) and functionally-equivalent known re-closable seals. Such seals typically include a narrow ridge present on one panel of film that is capable of frictionally engaging a complimentary groove present on an adjacent second panel of film to form an air-tight seal as is known in the art. FIG. 6 shows various portions of an article according to the disclosure C, D, E, F, G wherein in some embodiments C, D, E, F are locations at which first seal 3 as herein described is present, and a frangible seal is disposed along location G. According to some embodiments, any segment of first seal 3 along C, D, E, F is replaced by a re-closable seal, including without limitation re-closable seals such as those sold under the trademark ZIP-LOC®. In one exemplary embodiment, G is a frangible seal 5, locations D, E, F are a first seal 3, as described, and C comprises a re-closable seal. In another exemplary embodiment, G is a frangible seal 5, location D is a first seal 3, as described, and locations C, D, F each comprise a re-closable seal. In some embodiments any number greater than one of locations C, D, E, F may comprise a re-closable seal in an article provided herein, location G being a frangible seal 5. Such variability of features described above are also useful in accordance with the embodiments shown and described in reference to FIG. 5. In alternate embodiments, frangible seal 5 located at G may be a re-closable seal, including without limitation ZIP-LOC® seals. In one exemplary embodiment, locations C, G, E each comprise a re-closable seal including without limitation ZIP-LOC® seal, and D and F comprise a first seal 3. A re-closable seal, when selected to be present, is readily incorporated into an article provided herein using known methods in the art for providing re-closable seals on pouches comprised of polymer films. This can include modifying the shapes of surfaces present on fixture 12 shown and described in relation to FIG. 3 that contact the polymer film layers so that heat sufficient for fusion is only provided along locations at which first seal 3 is desired to be present, with no heat being applied to a previously-affixed re-closable seal. In alternate embodiments, all seals desired to be present on the article are provided and the re-closable seal is provided to article 10 as a final step in production.

In some embodiments, an article as provided herein includes a breakaway pull open or tear open seal along an edge portion of the article, to facilitate opening of a pouch provided, after frangible seal 5 has been ruptured and the contents of pouches 7, 9 have been mixed. As mentioned, in some embodiments an article as provided may be opened after the reactive components have been mixed, such as by cutting the pouch with scissors. Including breakaway pull open or tear open seal along an edge portion of an article provided herein eliminates the need to use an implement such as scissors to cut or open the article for removal of its contents. In embodiments including a breakaway pull open or tear-open seal along an edge portion of the article, any known seal used in packaging that comprises polymeric films that is manually openable by a person using their hands is suitable for use herein. One exemplary breakaway pull open or tear open seal is present on shredded natural swiss cheese product in six ounce size marketed by H-E-B of San Antonio, Tex. under UPC 41220 71608. This feature may also include a notch N (FIG. 6) or tear present on the perimeter of an article as provided, which serves as a starter location for a person to pull and rip off a portion of the article, enabling the contents to be poured onto a substrate. With reference to FIG. 6, in one embodiment, G is a frangible seal 5, locations D, E, F are a first seal 3, as described, and C comprises a breakaway pull open or tear open seal.

In some embodiments which include a re-sealable closure along a perimeter of an article provided hereby, a selected segment of first seal 3 is made to be frangible, that selected segment being adjacent to and extending alongside the re-sealable closure. In use of such articles, one applies sufficient pressure to rupture the frangible seal, enabling admixture of the contents of two adjacent pouches present on the article. After kneading for admixture, additional pressure is applied to the pouch which causes the segment of the first seal 3 that was made to be frangible to rupture, enabling the pouch's contents to be poured out, provided the re-sealable closure is open. Closing the re-sealable closure again protects the pouch's contents from ambient conditions.

Figure 7:
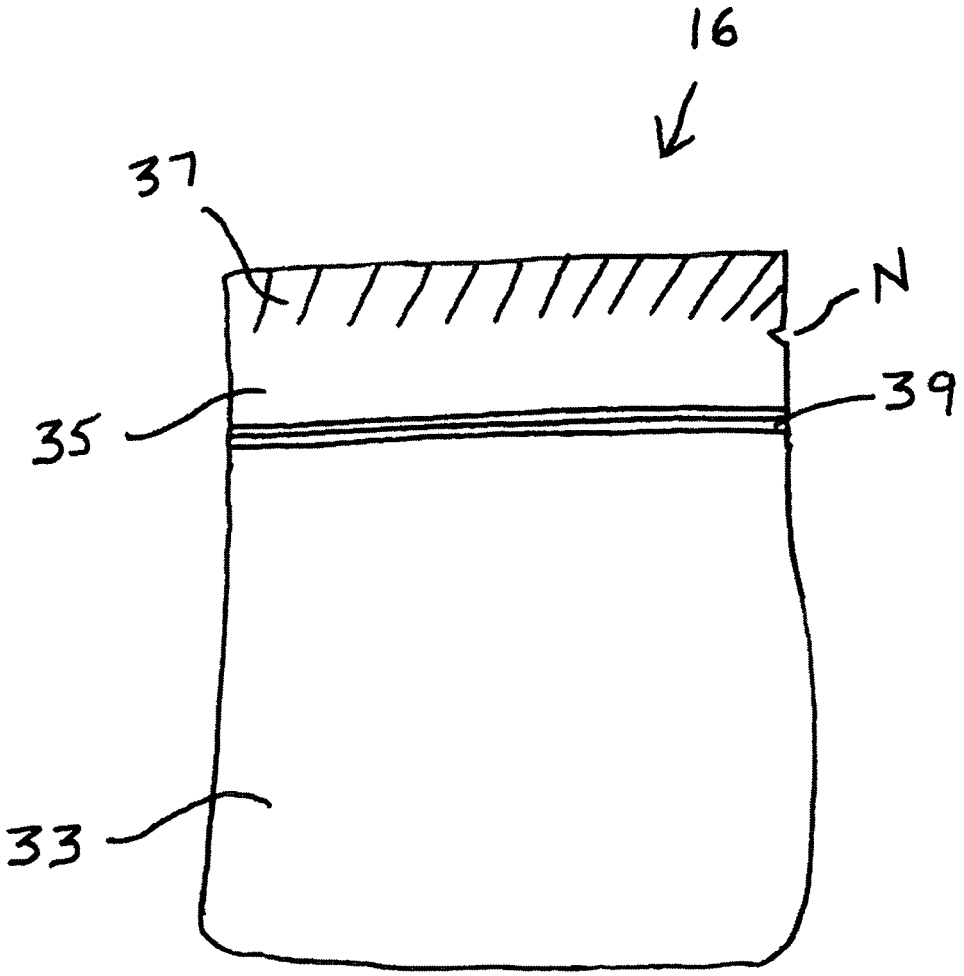
FIG. 7 is a frontal view of an article according to some embodiments of the disclosure.

In FIG. 7 is shown a frontal view of an article 16 according to some embodiments of the disclosure. In such embodiments article 16 comprises a pouch body 33, which is generally a container capable of containing liquid substances and having a top portion 35 that is configured to be selectively opened and re-sealed by virtue of the presence of a re-sealable closure 39. There is a tear seal 37 present at the uppermost portion of the article 16, indicated by the hashed lines.

An article 16 according to various embodiments is caused to contain a liquid, one-part, moisture-curable coating composition, which liquid is selected without limitation from the group consisting of: any one-part moisture-curable polyurethane composition, and any one-part, moisture-curable polyurea coating composition, including those previously mentioned. To provide a coating composition according to the disclosure using an article 16 that contains a one-part, moisture-curable liquid composition, the user simply rips the substantially-rectangular tear seal 37 off from the remainder of article 16, the ease of which is facilitated by the presence of notch N. Once tear seal 37 has been removed, the upper portion 35 of the pouch body 33 is opened by pulling each layer of material present at the re-sealable closure 39 apart from one another to provide an opening at the upper portion 35 through which any selected amount of the contents of pouch body 33 may be dispensed, including by pouring the contents out.

One aspect of the use of an article 16 as specified herein is that for cases where it is only necessary to employ less than the entire contents of the pouch body 33 in a particular application, article 16 is readily re-sealable, thus preserving the unused portion of the pouch body's contents in a stable state for future use.

Another aspect of the use of an article 16 as specified herein is that the pouch body 33 can be opened at its upper portion 35, and any one of various selected colorants can be added to the contents of the pouch body, the re-sealable closure 39 being subsequently resealed, and the article 16 then shaken or agitated in order to homogeneously disperse the added colorant(s) within the liquid present in the pouch. Once mixed, the pouch is re-opened and its contents used as desired to provide a coating on a substrate after it as been spread and once the dispensed material has cured.

The pouch of an article 16 is in some embodiments made of materials that were previously specified as being suitable materials from which to provide first layer 25 and second layer 27. The panels from which an article 16 may be constructed are in some embodiments flexible panels cut from sheets of laminate web materials known in the art, which are welded together on all but one side.

The re-sealable closure 39 is comprised of any known structure that is capable of enabling the pouch body 33 to be selectably opened to, and sealed at a location in proximity of the upper portion 35, from the ambient surroundings of the article 16. Those skilled in the art are aware of such suitable re-sealable closures. In some embodiments the re-sealable closure 39 is built in to the remaining portions of the article 16, as shown. In some embodiments the re-sealable closure 39 is comprised of a polymeric material that is welded to the remaining portions of the article 16, as shown. Non-limiting examples of such re-sealable closures include those sold under the Zip-loc® trademark by the SC Johnson Company of Racine, Wis. In some embodiments re-sealable closure 39 comprises interlocking profile extrusions disposed on the interior portion of pouch body 33. Such interlocking profile extrusions in some embodiments are of the type which require a rider or zipper to effect closure/opening of the article. In other embodiments such interlocking profile extrusions are of the type which do not require a rider or zipper to effect closure/opening of the article. U.S. Pat. No. RE28,969 to Naito shows one example of suitable re-sealable closures.

Figure 8:
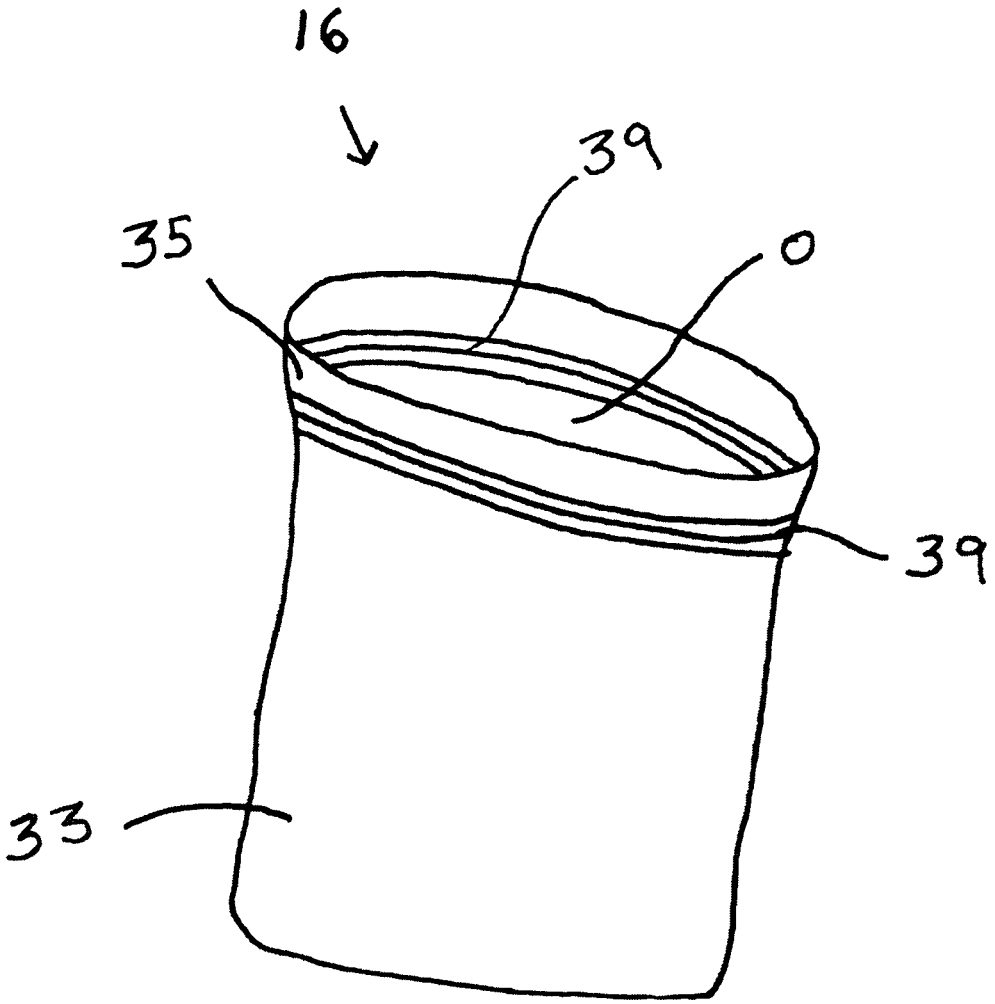
FIG. 8 is a perspective view of an article according to some embodiments of the disclosure.

In FIG. 8 is shown a perspective view of an article 16 according to some embodiments of the disclosure, from which the tear seal 37 has been removed. In FIG. 8 the articles' upper portion 35 is in an open configuration showing opening O, leading to an interior volume inherently present within and defined by the panels that comprise pouch body 33, in which liquid curable coatings compositions are contained and may be stored. Also shown is re-sealable closure 39.

Figure 9:
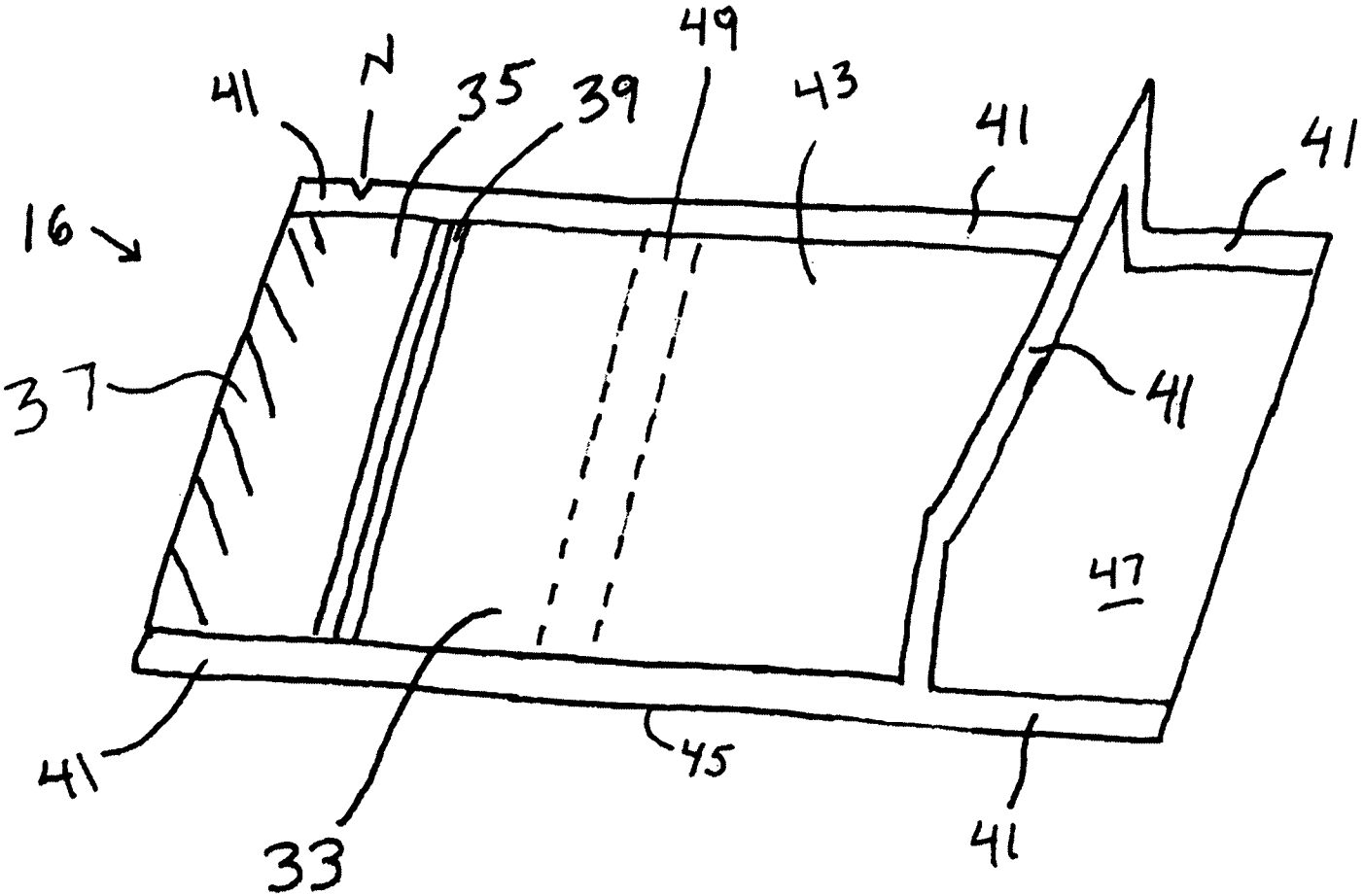
FIG. 9 is a perspective view of an article 16 according to some embodiments, wherein pouch body is devoid of any contents.

In FIG. 9 is shown a perspective view of an article 16 according to some embodiments, wherein pouch body 33 is devoid of any contents. In some embodiments the article 16 comprises a plurality of panels which are fastened together at welds 41, which in some embodiments are thermowelds made by application of heat to the perimeter edges of each of the panels employed. Shown also in FIG. 9 are the respective locations of upper portion 35, re-sealable closure 39, notch N, and tear seal 37. In some embodiments, article 16 is made from three substantially planar or planar panels: a front face panel 43, a rear face panel 45 (on underside of 16 in FIG. 9, not visible), and a bottom panel 47. In some embodiments only two panels are employed, panels 45 and 47 comprising the same panel.

In some embodiments, an article 16 includes a frangible seal 49 at any location across the pouch body 33, so as to provide two separate compartments in article 16 as previously described for other embodiments employing reactive mixtures provided by admixture of two components. Suitable frangible seal(s), when present in such embodiments, have aspects as previously described. In some embodiments, two frangible seals 49 are present, which create three separate compartments in article 16, within each of which compartments are contained components which, when mixed as previously described, provide a reactive mixture from which a coating composition results.

Consideration must be given to the fact that although this invention has been described and disclosed in relation to various embodiments, modifications, combinations, and alterations of the features of various embodiments disclosed may become apparent to persons of ordinary skill in this art after reading and understanding the teachings of this specification, drawings, and the claims appended hereto. The present disclosure includes subject matter defined by any combinations of any one (or more) of the features, elements, or aspects present in any embodiment described in this disclosure with features, elements, or aspects described in relation to any other one (or more) embodiments described. These combinations include the incorporation of the features and/or limitations of any dependent claim, singly or in combination with features and/or limitations of any one or more of the other dependent claims, with features and/or limitations of any one or more of the independent claims, with the remaining dependent claims in their original text being read and applied to any independent claims so modified. These combinations also include combination of the features and/or limitations of one or more of the independent claims with features and/or limitations of another independent claims to arrive at a modified independent claim, with the remaining dependent claims in their original text or as modified per the foregoing, being read and applied to any independent claim so modified. The present invention has been disclosed and claimed with the intent to cover modifications and alterations that achieve substantially the same result as herein taught using substantially the same or similar structures to the maximum permissible extent, being limited only by the scope of the claims which follow.

The invention claimed is:

1. An article useful for containing plural components of a mixture in distinct compartments and their subsequent mixing within said article, comprising:

a first layer of material;

a second layer of material sealingly attached to said first layer along a first seal; and a frangible seal along which said first layer of material is sealingly attached to said second layer of material, said frangible seal being configured and located sufficiently to define a first pouch having a first interior volume and at least a second pouch having a second interior volume in said article, said first pouch containing a first substance and said second pouch containing a second substance that is chemically reactive towards said first substance, said substances yielding upon their admixture a mixed composition from which a cured polymeric material selected from the group consisting of: polyurethane polymers, polyurea polymers, epoxy polymers, acrylic polymers, and polyaspartic polymers may be provided, wherein the strength of said frangible seal is less than that of said first seal by an amount sufficient to enable a person to apply pressure to one of said pouches causing rupture of said frangible seal and admixture of said first and said substances, without causing said first seal to rupture, and wherein said first seal has a strength sufficient to not be ruptured until a pressure differential of at least 7.5 psi is caused to exist between a volume within said article and ambient pressure.

2. An article according to claim 1 wherein said frangible seal is of sufficient strength to not be ruptured under ambient conditions until a first pressure differential exceeding two pounds per square inch is caused to exist between the interior volumes of said first pouch and said second pouch, and wherein the strength of said first seal is sufficient to not be ruptured under ambient conditions until a second pressure differential exceeding that required for rupture of said frangible seal by at least one pound per square inch is caused to exist between a volume within said article and the ambient pressure, subsequent to rupture of said frangible seal.

3. An article according to claim 1 wherein said first seal comprises a continuous loop.

4. An article according to claim 1 wherein said first pouch is bounded by a portion of said first layer, a portion of said second layer, said first seal and said frangible seal.

5. An article according to claim 1 wherein said second pouch is bounded by a portion of said first layer, a portion of said second layer, said first seal, and said frangible seal.

6. An article according to claim 1 comprising a tape layer structure disposed between said first layer and said second layer.

7. An article according to claim 6 wherein said tape layer structure comprises at least one polymeric material.

8. An article according to claim 1 wherein said first layer of material is attached to said second layer of material at a tape layer structure present between and in contact with each of said layers along said first seal and said frangible seal.

9. An article according to claim 1 wherein at least one of said first layer and said second layer comprises at least one polymeric material.

10. An article according to claim 1 wherein each of said first layer and said second layer have a perimeter, and wherein said first seal is located substantially along the perimeter of said first layer and said second layer.

11. An article according to claim 1 wherein said mixed composition is in a liquid state suitable for use as a coating to be applied to a substrate.

12. An article according to claim 1 wherein said article includes a re-sealable closure along at least any one selected segment of the perimeter of said article.

13. An article according to claim 12 wherein said first seal comprises a frangible portion along its length and is adjacently disposed to the location of said re-sealable closure, sufficiently to enable said article to be re-sealed after rupture of said adjacently-disposed frangible portion.

14. An article according to claim 1 wherein said article is substantially rectangular as viewed from an overhead perspective, being about 45 centimeters long and about 25 centimeters wide, wherein said first pouch has a volume that is in the range of between 300 milliliters and 500 milliliters, and wherein said second pouch has a volume that is in the range of between 800 milliliters and 1200 milliliters.

15. An article according to claim 1 wherein said article is substantially rectangular as viewed from an overhead perspective, being about 45 centimeters long and about 25 centimeters wide, wherein said first pouch has a volume of about 500 milliliters and wherein said second pouch has a volume of about one liter.

16. An article according to claim 1 wherein the width of said first seal is any width in the range of between about three millimeters and about forty millimeters.

17. An article according to claim 1 wherein the width of said frangible seal is any width in the range of between about one millimeter and about forty millimeters.

18. An article according to claim 17 wherein the width of said frangible seal is any width in the range of between about one millimeter and about forty millimeters.

19. An article according to claim 1 further comprising a second frangible seal sufficiently disposed so as to cause three separate pouches to exist in said article between said layers.

20. An article according to claim 19 wherein said frangible seal and said second frangible seal each rupture upon being subjected to different levels of applied pressure, which levels are different than the pressure required to rupture said first seal.

* * * * *